United States Patent [19]

Walty

[11] 4,398,084

[45] Aug. 9, 1983

[54] END SEAL FOR STRIP HEATERS

[75] Inventor: Robert J. Walty, Redwood City, Calif.

[73] Assignee: Raychem Corporation, Menlo Park, Calif.

[21] Appl. No.: 273,525

[22] Filed: Jun. 15, 1981

[51] Int. Cl.[3] ..... H05B 3/34

[52] U.S. Cl. ..... 219/528; 219/544; 219/549; 219/553; 29/611; 264/105; 338/22 R

[58] Field of Search ..... 219/505, 528, 541, 544, 219/549, 553; 338/22 R, 22 SD, 212, 211, 240; 29/611; 264/22, 104, 105; 428/214, 428; 174/52 PE

[56] References Cited

U.S. PATENT DOCUMENTS

| | | | |
|---|---|---|---|
| 3,344,385 | 9/1967 | Bartos et al. | 219/528 X |
| 3,878,362 | 4/1975 | Stinger | 219/528 |
| 3,900,654 | 8/1975 | Stinger | 428/214 |
| 4,055,526 | 10/1977 | Kiyokawa et al. | 264/22 |
| 4,058,704 | 11/1977 | Shimizu | 219/528 |
| 4,074,222 | 2/1978 | Kiyokawa et al. | 338/212 |
| 4,104,509 | 8/1978 | Bokestal et al. | 219/544 |
| 4,121,093 | 10/1978 | Wainwright | 219/528 |
| 4,200,973 | 5/1980 | Farkas | 29/611 |
| 4,315,237 | 2/1982 | Middleman et al. | 338/22 R |

FOREIGN PATENT DOCUMENTS 2038549 7/1980 United Kingdom .

*Primary Examiner*—Volodymyr Y. Mayewsky
*Attorney, Agent, or Firm*—Derek P. Freyberg; T. H. P. Richardson

[57] ABSTRACT

A method and apparatus for sealing the end of a conductive polymeric strip heater, especially one for immersion use, greatly reduces the possibility of failure due to fluid ingress.

2 Claims, 16 Drawing Figures

END SEAL FOR STRIP HEATERS

FIELD OF THE INVENTION

This invention relates to conductive polymeric strip heaters, and particularly to end seals for such heaters.

SUMMARY OF THE PRIOR ART

In the past several years, conductive polymer based strip heaters (i.e. heaters which are relatively long and thin) have achieved considerable popularity for "heat-tracing" and similar functions. One of their notable advantages over their alternatives, which include steam lines and resistance wire heaters, is their simplicity of installation and use. Because the heating effect is produced by the passage of current through a conductive polymeric composition between electrodes which run the length of the strip, the heater produces a certain output of heat per unit length, and this output is essentially independent of the total length of the heater. Thus the heater may be simply cut to the appropriate length for the desired use, and the electrodes attached at one end to the power supply by means of lead wires, etc.

The basic requisite for the other end of the heater is that a new conducting path (i.e. one which does not pass through the conductive polymer) should not develop between the electrodes. If such a conducting path does develop, the heater may short-circuit or an arc or fire may develop at the end of the heater (the fire is sometimes known as a wet wire fire, since it may readily occur if the heater end is wet with an electrolyte).

The most severe short-circuit problem will occur if the electrodes at the cut end of the heater are allowed to come into contact, and it is thus normal practice to cut off the end of the heater in such a way that the electrodes do not protrude beyond the conductive polymeric layer. This may normally be done simply by a cut perpendicular to the heater axis with a sharp-edged cutting tool.

However, even if this drastic short-circuit is eliminated, the problem of wet wire fires remains of considerable importance.

The conventional approach to the problem has been to attempt to prevent an electrolyte from coming into contact with the cut end. This has usually been achieved by some sort of enclosing of the cut end, as for example by:

(1) enclosing the cut end in an end cap containing a gasket which surrounds the heater and is compressed against it to provide a mechanical seal;

(2) potting the cut end in a curable adhesive, such as an RTV silicone, usually enclosed in an end cap of compatible material; or (3) recovering over the cut end a heat shrinkable plastic end cap, usually containing a hot-melt or thermoset adhesive.

These prior art methods are, while in general satisfactory for most applications, susceptible to problems, especially when the heater is to be used as an immersion heater.

Problems with the mechanically closed (gasket) end cap include degeneration of the seal between cap and heater and leak development within the cap itself.

Problems with the potted or heat shrinkable end cap include particularly those of compatability between the various materials, i.e. the conductive polymer, the jacketing of the heater, the potting or adhesive compound, and the material of the end cap itself. Differences in these materials make it relatively easy for microscopic leak paths to develop at the interfaces.

Furthermore, if a pinhole should develop in the jacket of the heater outside the end cap or water should be able to enter the other end of the heater, it is possible that an electrolyte leak path could develop down to the end by capillary action.

With these problems in mind, it is desirable to develop an apparatus and method for end sealing strip heaters that will render them less susceptible to short circuits, arcing, and wet wire fires; especially when the heater is to be used as an immersion heater.

DESCRIPTION OF THE INVENTION

Summary of the Invention

I have discovered that if the metallic electrodes of the cut end of a strip heater are shielded from possible contact with an electrolyte by treatment of the cut end so that the conductive polymeric heater material is extruded over the ends of the electrodes, then the probability of short-circuits, arcing, and wet wire fires may be substantially decreased.

BRIEF DESCRIPTION OF THE DRAWING

FIG. 2 depicts, in plan, an example of an end seal according to this invention while

FIGS. 4A and 4B are schematic views of a tool suitable for the end sealing of a strip heater by the method of this invention, while

DETAILED DESCRIPTION OF THE INVENTION

It has been discovered that, when the conductive polymeric material of a strip heater is extruded to cover the ends of the metallic electrodes, the incidence of electrical problems may be decreased.

Figure 1A:
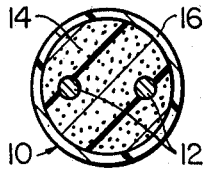
FIGS. 1A, 1B and 1C show, in cross-section, some examples of strip heaters employing conductive polymers.
Figure 1B:
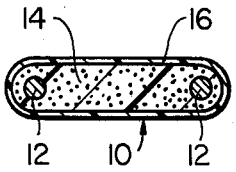
Figure 1C:
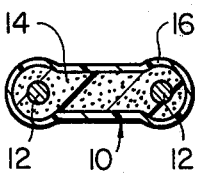

A strip heater comprises at least two electrodes, which are generally metallic, and which are embedded in a conductive polymeric material. Such heaters are well-known. FIGS. 1A, 1B and 1C show, in cross-section, some examples of strip heaters. In FIG. 1A, the heater is of approximately circular cross-section; in FIG. 1B it is flat; and in FIG. 1C, it has a narrower central section, usually known as a "dog-bone". In each case, the heater shown generally at 10 comprises electrodes 12, a conductive polymeric composition 14, and an insulating plastic jacket 16. Further jacketing, or reinforcing braid, or both, may overlay the jacket 16 if required, but such has not been shown. My invention is applicable to strip heaters of almost any configuration, though the tool used to perform the sealing will, of course, vary in configuration with the heater to be sealed, as will become obvious from the specification.

Further, although the electrodes have been depicted as being metallic and of circular cross-section, it is to be understood that my invention is applicable to other electrode configurations or materials.

Figure 2:
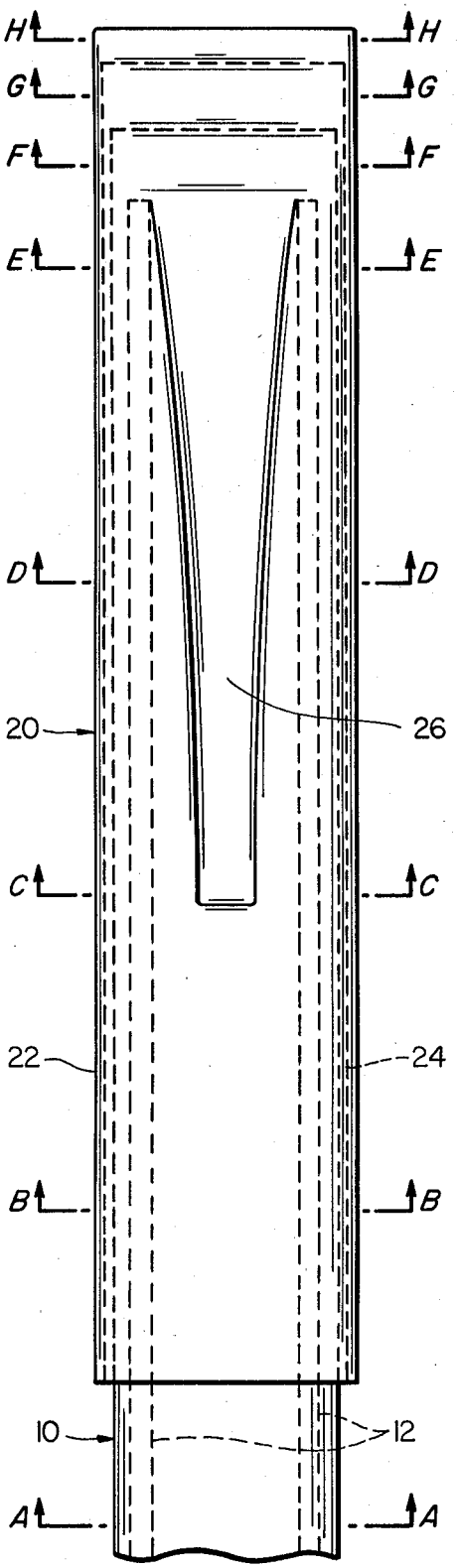

FIG. 2 depicts, in plan, an end seal according to this invention formed in a strip heater of the configuration shown in FIG. 1B. FIGS. 3A through 3H depict a series of cross-sections through the seal of FIG. 2. Though the details of FIGS. 2 and 3A through 3H relate specifically to the configuration of FIG. 1B, it will be understood that the essential feature of this invention, i.e. the extrusion of the conductive polymer over the ends of the electrodes, is merely illustrated by FIGS. 2 and 3, and no limitation to a particular configuration of strip heater is intended.

In FIG. 2, the strip heater shown generally at 10 has been sealed inside on end cap shown generally at 20 which comprises a polymeric cap 22 lined with an adhesive 24. The provision of the end cap 20 over the seal of this invention is a preferred feature.

To provide conductive polymeric material sufficient to cover and seal the ends of the electrodes, polymeric material from between the electrodes is extruded toward the end of the heater. The extrusion illustrated in FIGS. 2 and 3A through 3H is produced by a wedge-shaped die section which produces the indentation shown generally at 26 in the sealed end.

The extent of the extrusion necessary, and the precise die shape to produce the extrusion, will depend on the cross-sectional shape of the heater. For example, when the heater has the cross-section of FIG. 1A, there will be a relatively greater amount of conductive polymer available for extrusion, and a simple crushing of the end under heat and pressure may well prove sufficient. It is also within the contemplation of my invention that the extrusion may be augmented by the provision of a separate piece of polymeric material, especially one compatible with, or identical to, the conductive polymer, at the end of the heater before extrusion occurs. This piece will preferably, under the extrusion conditions, bond to the extruded conductive polymer to augment the seal.

Figure 3H:
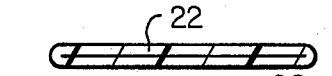
FIGS. 3A through 3H show cross-sections of that seal.
Figure 3G:
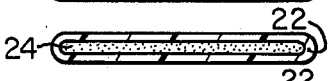
Figure 3F:
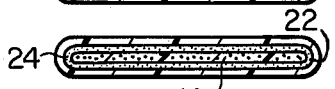
Figure 3E:
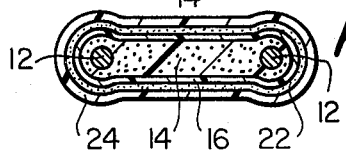
Figure 3D:
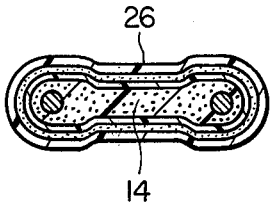
Figure 3C:
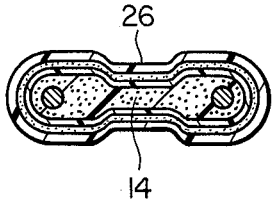
Figure 3B:
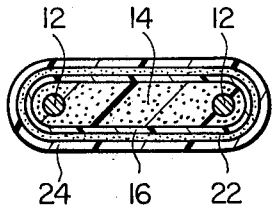
Figure 3A:
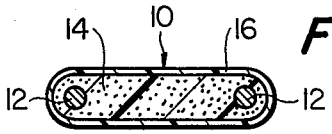

FIGS. 3A through 3H depict a series of cross-sections through FIG. 2. FIG. 3A, a cross-section through line A—A of FIG. 2, is a cross-section of the heater 10 alone, showing electrodes 12, conductive polymer 14, and jacket 16. FIG. 3B shows the beginning of the capped seal, and includes adhesives 24 and cap 22. FIG. 3C is a cross-section through the area of the indentation 26. As can be seen, in the region of the indentation, conductive polymeric material 14 has been extruded, narrowing the cross-section of the heaters. FIGS. 3D and 3E are further cross-sections comprising the indentation 26. FIG. 3F is a section beyond the end of the heater, where the conductive polymer 14 has been extruded by the indentation 26 beyond the end of the electrodes. It is this extrusion and the consequent sealing of the electrode ends, that is the essence of my invention. FIG. 3G is a section beyond the extruded conductive polymer, and shows adhesive 24 and the cap material 22; while FIG. 3H is a section through the cap material 22 alone.

The wedge-shaped indentation 26 in FIGS. 2 and 3A through 3H is particularly advantageous in that it aids in retention of the heater within the sealing tool during the sealing process, but this is not an essential feature of the invention.

The extrusion process to produce the end seal is generally performed at a temperature above the melting point of the conductive polymer material, and that of any additional piece of polymer which may be present to augment the seal. The temperature and pressure required for adequate extrusion will be readily determined by one skilled in the art in view of this disclosure.

Figure 4A:
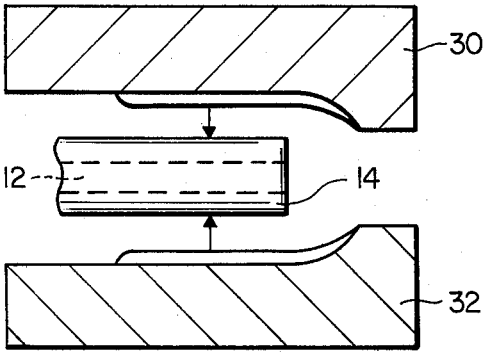
Figure 4B:
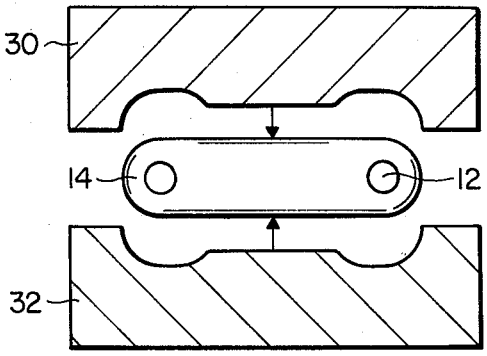

FIG. 4 illustrates schematically the tool used to produce the end seal. In them, and in FIGS. 5A and 5B, which illustrates the sealed heater end, no cap or adhesive are shown, though they may be present if desired. The jacket of the heater has also been omitted for clarity. In FIGS. 4A and 4B, a heater shown generally at 10 has been inserted into the tool, which comprises heated dies 30 and 32. Means for heating the dies and for applying pressure to them to cause the extrusion have not been shown. FIG. 4A shows the dies and heater in side view, while FIG. 4B shows them in end view, in each case with the dies apart. The dies 30 and 32 are then closed about the heater 10 so that heat and pressure are applied to the heater to extrude the conductive polymer.

Figure 5A:
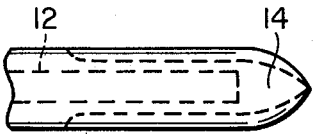
FIGS. 5A and 5B show the seal formed.
Figure 5B:
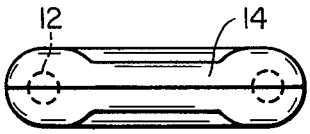

FIGS. 5A and 5B illustrate the resulting configuration of the sealed end, with FIG. 5A being a side view and FIG. 5B an end view.

The sealing and capping of the end of the heater may be performed sequentially or simultaneously, as desired. It is presently considered preferable to perform them sequentially in that the end sealing may be inspected before the seal is covered by the cap.

Having described my invention in detail with respect to certain preferred embodiments and illustrations, it is to be understood that my invention is not limited to these illustrations, but its scope is to be determined solely by the claims.

I claim:

1. A conductive polymeric strip heater, which comprises at least two elongate electrodes embedded in a a strip of a conductive polymeric composition, one end of said heater having been cut to length and then sealed by extruding an end portion of said strip of conductive polymeric composition to cover the cut ends of said electrodes and to reduce the cross-sectional area of said end portion.

2. The heater of claim 1 which further comprises a polymeric end cap placed about the sealed end.

* * * * *